US010617195B2

(12) United States Patent
Coleman et al.

(10) Patent No.: US 10,617,195 B2
(45) Date of Patent: Apr. 14, 2020

(54) ARTICULATING BACKPACK FRAME

(71) Applicant: Jeremy Nathan Coleman, Duck River, TN (US)

(72) Inventors: Jeremy Nathan Coleman, Duck River, TN (US); Kevin Timm, Ridgway, CO (US)

( * ) Notice: Subject to any disclaimer, the term of this patent is extended or adjusted under 35 U.S.C. 154(b) by 0 days.

(21) Appl. No.: 14/324,321

(22) Filed: Jul. 7, 2014

(65) Prior Publication Data

US 2015/0076195 A1 Mar. 19, 2015

Related U.S. Application Data

(60) Provisional application No. 61/958,067, filed on Jul. 19, 2013.

(51) Int. Cl.
*A45F 3/08* (2006.01)

(52) U.S. Cl.
CPC ..... *A45F 3/08* (2013.01)

(58) Field of Classification Search
CPC ..... A45F 3/08; A45F 3/10; A45F 2004/006
See application file for complete search history.

(56) References Cited

U.S. PATENT DOCUMENTS 4,911,346 A * 3/1990 Shallman ..... A45F 3/08 224/153
5,836,489 A * 11/1998 Swetish ..... A45F 3/10 224/262
7,537,143 B1 * 5/2009 Collier ..... A45F 3/08 224/633
7,931,178 B2 * 4/2011 Rome ..... A45F 3/04 206/315.3
8,181,834 B1 * 5/2012 Howell ..... A45F 3/04 150/130
8,312,600 B2 * 11/2012 Colorado ..... A62B 9/04 224/637
2004/0256426 A1 * 12/2004 Sanderson ..... A45C 13/38 224/201
2008/0203128 A1 * 8/2008 Bass ..... A45F 3/047 224/628
2008/0203129 A1 * 8/2008 Frei ..... A45F 3/04 224/637
2009/0015022 A1 * 1/2009 Rome ..... A45F 3/08 290/1 A
2009/0212081 A1 * 8/2009 Liang ..... A45F 3/04 224/148.2
2010/0032464 A1 * 2/2010 Gleason, Jr. ..... A45F 3/08 224/631
2013/0126564 A1 * 5/2013 Savage, Sr. ..... A45F 4/02 224/155
2015/0189974 A1 * 7/2015 Bercaw ..... A45F 3/04 224/633

* cited by examiner

*Primary Examiner* — Derek J Battisti

(74) *Attorney, Agent, or Firm* — The Sladkus Law Group

(57) ABSTRACT

A backpack frame with one or more pivoting joints that allows the separate sections of the frame to move independently from one another, thus allowing the frame to match the movements of the backpack wearer's upper body.

16 Claims, 7 Drawing Sheets

ARTICULATING BACKPACK FRAME

CROSS-REFERENCE TO RELATED APPLICATIONS

This application claims the benefit of and priority to U.S. Provisional Patent 61/958,067, filed Jul. 19, 2013, which is incorporated in its entirety in this document by reference.

BACKGROUND OF THE INVENTION

The present invention is in the technical field of backpacks. More particularly, the present invention is in the technical field of backpack frames.

Within the field of backpack frames there is a distinction between internal frame backpacks and external frame backpacks. Internal frame backpacks are known for flexing and moving with the wearer's body which provides comfort at light loads, but this frame flex is uncomfortable at heavy loads. External frame backpacks are strong, stiff, and capable of stabilizing heavy loads in comfort, but they are stiff and inflexible which makes them less comfortable at light loads.

SUMMARY

It is an object of this invention to provide a rigid and strong backpack frame to support heavy loads.

It is an object of this invention to provide an articulating action that will allow the individual sections of the frame to move independently of each other which will allow the frame to move with the user's upper body. This articulation creates comfort at all load weight ranges.

The present invention comprises an articulating backpack frame with one or more pivoting joints that is strong and stiff to support heavy loads comfortably, and is also comfortable at light loads due to the backpack frame articulation that allows it to match the wearer's movements.

Related methods of operation are also provided. Other apparatuses, methods, systems, features, and advantages of the cavity enhancement system and the method of its use will be or become apparent to one with skill in the art upon examination of the following figures and detailed description. It is intended that all such additional apparatuses, methods, systems, features, and advantages be included within this description, be within the scope of the cavity enhancement system and the method of its use, and be protected by the accompanying claims.

DETAILED DESCRIPTION OF THE INVENTION

Figures 1, 2:
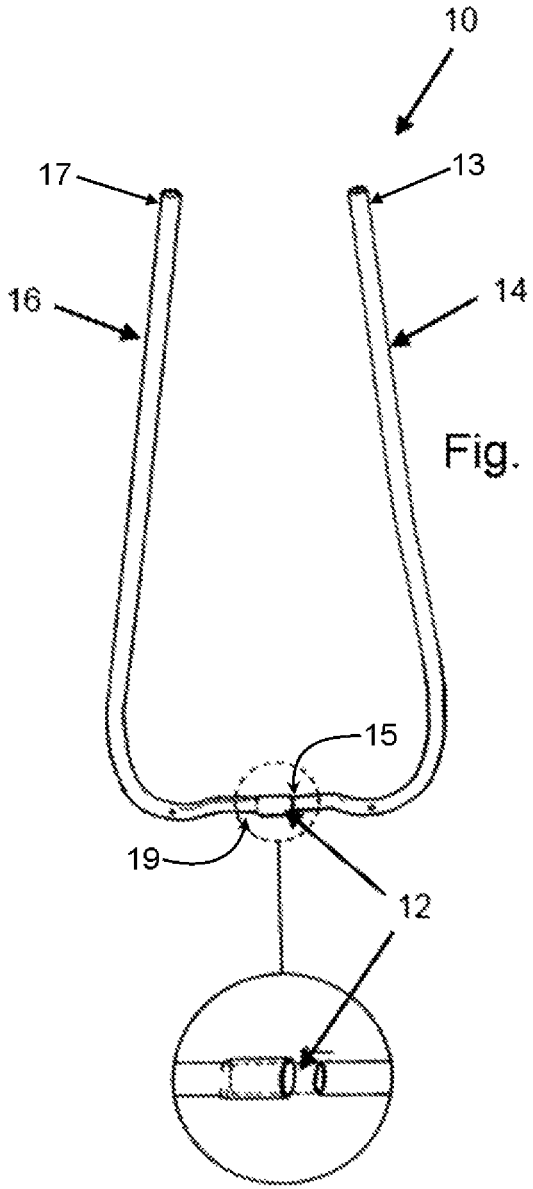
FIG. 1 is a perspective view of a backpack frame invention comprising a pivoting joint, according to one aspect.
FIG. 2 is an enlarged perspective view of the pivoting joint of FIG. 1.
Figure 3:
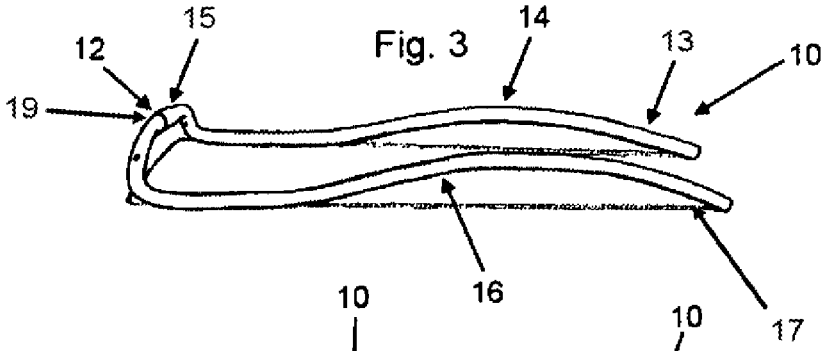
FIG. 3 is a perspective view of the backpack frame of FIG. 1.
Figure 4:
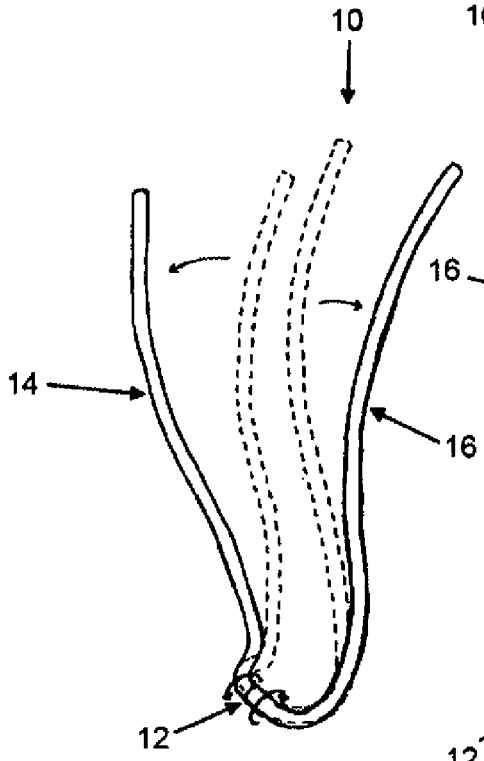
FIG. 4 is a perspective view of the backpack frame of FIG. 1 showing an articulating motion.
Figure 5:
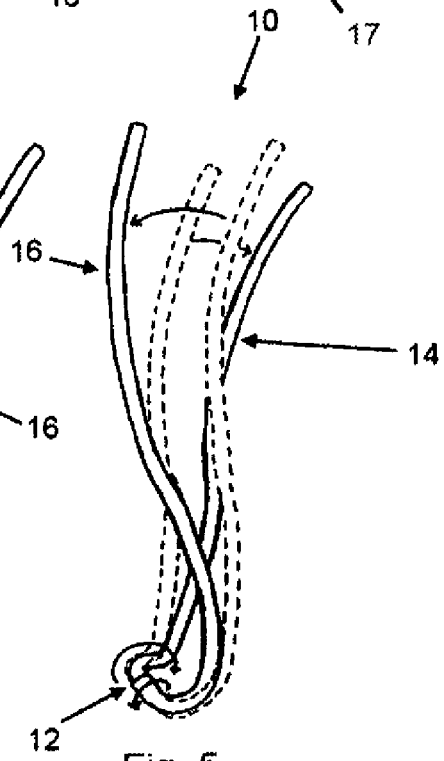
FIG. 5 is a perspective view of the backpack frame of FIG. 1 showing an articulating motion.

The present systems and apparatuses and methods are understood more readily by reference to the following detailed description, examples, drawing, and claims, and their previous and following descriptions. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching in its best, currently known embodiment. To this end, those skilled in the relevant art will recognize and appreciate that many changes can be made to the various aspects described herein, while still obtaining the beneficial results of the technology disclosed. It will also be apparent that some of the desired benefits can be obtained by selecting some of the features while not utilizing others. Accordingly, those with ordinary skill in the art will recognize that many modifications and adaptations are possible, and may even be desirable in certain circumstances, and are a part of the invention described. Thus, the following description is provided as illustrative of the principles of the invention and not in limitation thereof.

As used throughout, the singular forms "a," "an" and "the" include plural referents unless the context clearly dictates otherwise. Thus, for example, reference to "a" component can include two or more such components unless the context indicates otherwise. Also, the words "proximal" and "distal" are used to describe items or portions of items that are situated closer to and away from, respectively, a user or operator. Thus, for example, the tip or free end of a device may be referred to as the distal end, whereas the generally opposing end or far end may be referred to as the proximal end.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Referring now to the invention in more detail, in the range of FIG. 1 to FIG. 9 there is a backpack frame 10 having a pivoting joint 12, and being comprised of left frame section 14 and right frame section 16.

In more detail, still referring to FIG. 1 to FIG. 9 there is a pivoting joint 12 that allows left frame section 14 and right frame section 16 to move independently from each other. This independent movement is illustrated in range of FIG. 4 to FIG. 5.

In one aspect, the left frame section 14 can have a distal end 13 and an opposed proximal end 15. Similarly, the right frame section 16 can have a distal end 17 and an opposed proximal end 19. In another aspect, the pivoting joint can couple the proximal end of the left frame section to the proximal end of the right frame section. As can be seen in FIG. 1, when assembled, the backpack frame 10 can be substantially "U"-shaped with the proximal ends of each frame section substantially coaxially aligned. In a further aspect, the distal end 13 of the left frame section 14 and the distal end 17 of the right frame section 16 can be at an acute angle relative to each other.

In use, described more fully below, the left frame section 14 can move relative to the right frame section 16. In one aspect, at least a portion of the left frame section 14 can be rotatable relative to the right frame section 16. In another aspect, the left frame section can be rotatable about and between a first frame position, in which the distal end 13 of the left frame section and the distal end 17 of the right frame section are spaced from each other a first distance, and a second frame position, in which the distal end of the left frame section 14 and the distal end of the right frame section 16 are spaced from each other a second distance that is greater than the first distance. For example and without limitation, the first frame position can be illustrated in FIG. 3, in which the distal ends 13, 17 of the first and second frame sections are coplanar and spaced from each other the first distance. The second frame position can be illustrated in FIG. 4 or 5, in which the first frame section 14 and/or the second frame section 16 have been rotated relative to each other such that the space (the second distance) between the distal ends 13, 17 of the first and second frame sections is greater than the first distance.

Figure 6:
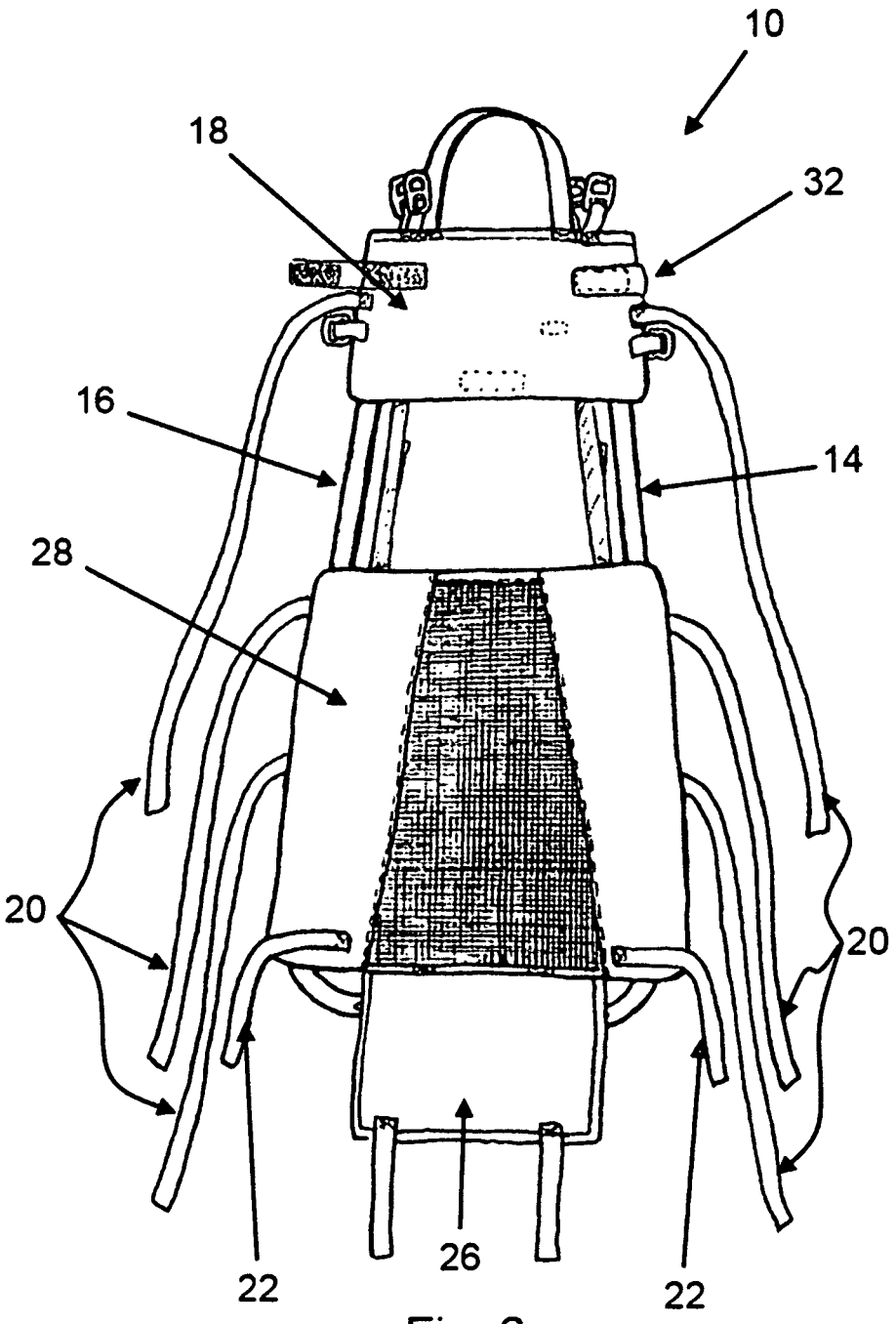
FIG. 6 is a back view of the backpack frame of FIG. 1 encased in a fabric cover.
Figure 7:
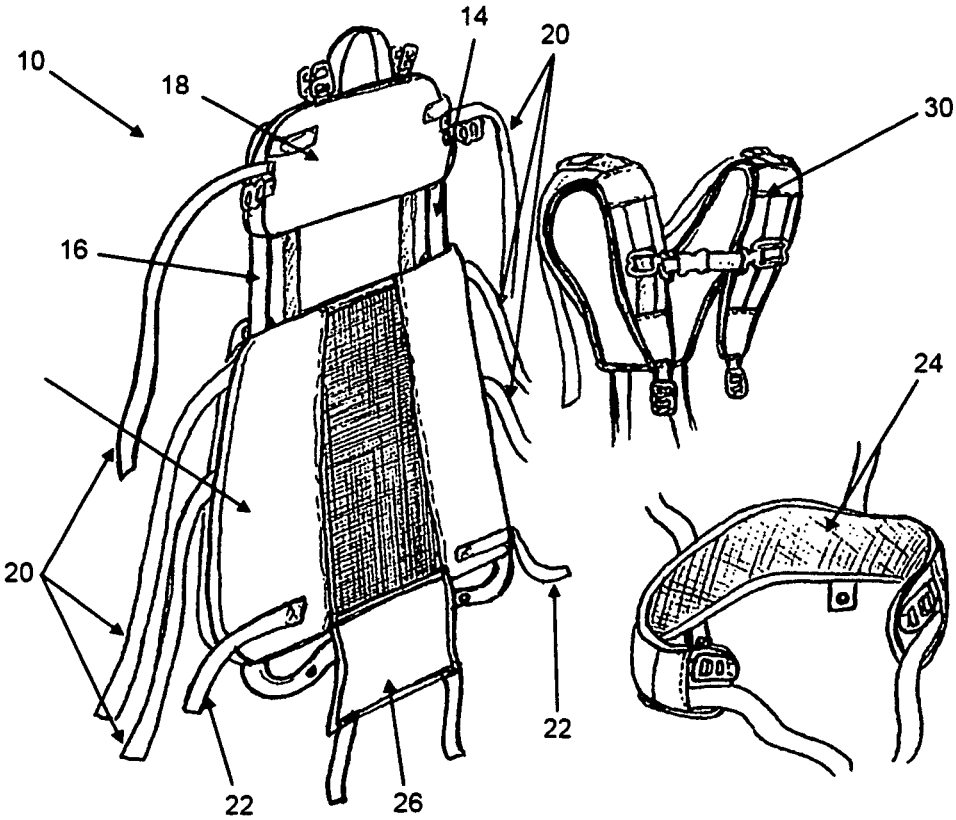
FIG. 7 is a perspective view of the backpack frame of FIG. 1 encased in a fabric cover with an associated hipbelt and shoulder harness.

FIG. 6 and FIG. 7 show a top encasement 18, a bottom encasement 28, a load shelf 26, compression straps 20, a spreader bar 32, the backpack frame 10, and pack bag attachments 22. The backpack frame 10 is inserted into the bottom encasement 28 and the top encasement 18 to control the articulating action of backpack frame 10. Further, top encasement 18 contains spreader bar 32 which acts to keep the top of backpack frame 10 equidistant. Compression straps 20 compress and stabilize a load against backpack frame 10. Shoulder harness 30 and hipbelt 24 attach to bottom encasement 28 and top encasement 18 to allow the backpack frame 10 to be worn by the backpack user.

Figure 8:
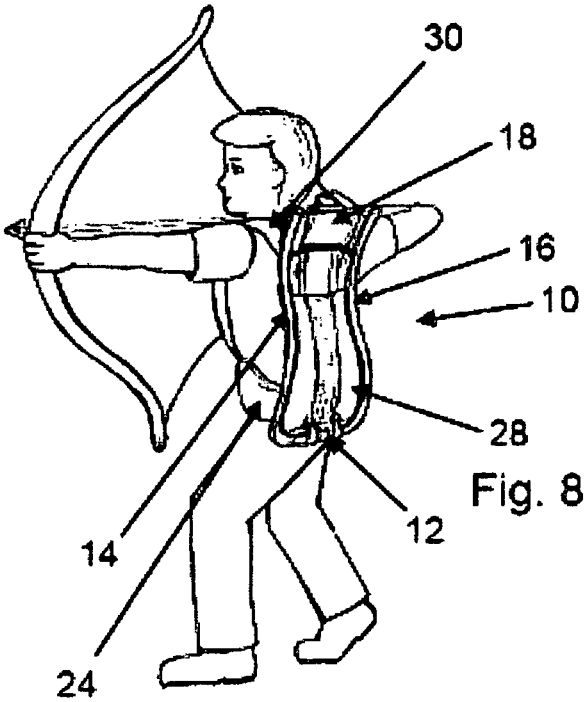
FIG. 8 is a side plan view of the backpack frame of FIG. 1 in use, showing frame articulation.
Figure 9:
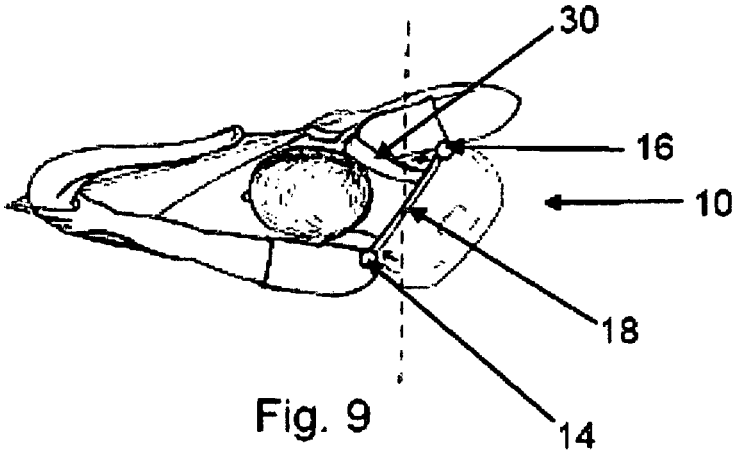
FIG. 9 is a top view of the backpack frame of FIG. 1 in use, showing frame articulation.

FIG. 8 and FIG. 9 illustrate backpack frame 10, bottom encasement 28, top encasement 18, shoulder harness 30, and hipbelt 24 articulating with the movements of the user's body as a bow is drawn.

In further detail, still referring FIG. 1 to FIG. 9, the backpack frame 10 is sufficiently wide and tall to provide comfortable carry of heavy loads, such as about 12 to 16 inches wide and about 22 to 36 inches tall. The pivoting joint 12 is a joint that allows either left frame section 14 or right frame section 16 to be inserted into the corresponding section of the backpack frame 10, and allows left frame section 14 and right frame section 16 to move independently of each other.

The construction details as shown in FIG. 1 to FIG. 9 are that the backpack frame 10 may be made of steel, titanium, aluminum, a composite of aluminum and carbon fiber, a composite of wood and carbon fiber, other metals, wood, plastic, carbon fiber, or any other sufficiently rigid and strong material capable of supporting heavy loads. Further, the pivoting joint 12 can be a slip joint, a ball joint, a U-joint, or any other such joint that allows the separate sections of the frame to move independently of each other. The other components of the backpack frame 10 such as the bottom encasement 28, top encasement 18, compression straps 20, shoulder harness 30, hipbelt 24, and all other components can be made from various materials such as fabric, plastic, metal, foam, webbing, carbon fiber, or any other such material.

Figure 10:
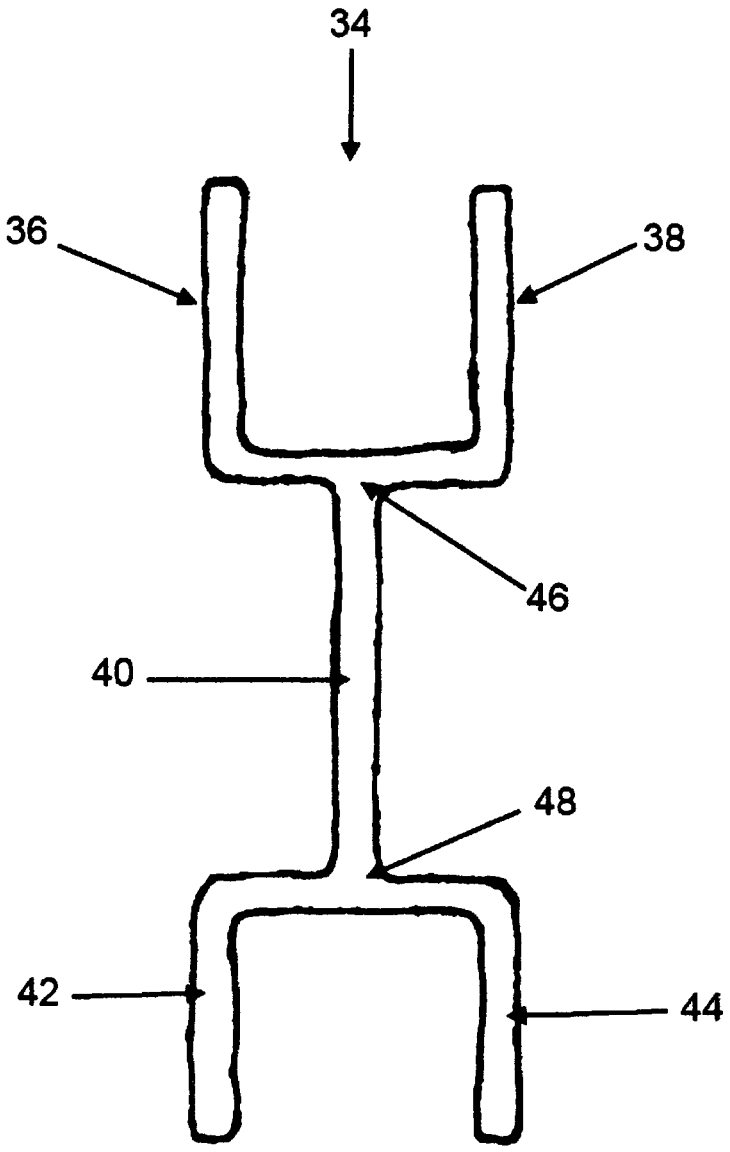
FIG. 10 is a front view of a backpack frame according to one aspect.

Referring now to the aspect shown in FIG. 10, there is shown a backpack frame 34 being comprised of an upper left frame section 36, an upper right frame section 38, a middle frame section 40, a lower left frame section 42, a lower right frame section 44, an upper pivoting joint 46, and a lower pivoting joint 48.

In more detail, still referring to FIG. 10, the backpack frame 34 is stiff and strong but upper left frame section 36, upper right frame section 38, lower left frame section 42, and lower right frame section 44 are allowed to articulate and move independently of each other due to upper pivoting joint 46 and lower pivoting joint 48.

In further detail, still referring to FIG. 10, the backpack frame 34 is sufficiently wide and tall to provide comfortable carry of heavy loads, such as about 12 to 16 inches wide and about 22 to 36 inches tall. The upper pivoting joint 46 is a joint that allows upper left frame section 36 and upper right frame section 38 to move independently of each other. Lower pivoting joint 48 is a joint that allows lower left frame section 42 and lower right frame section 44 to move independently of each other.

The construction details as shown in FIG. 10 are that the backpack frame 34 may be made of steel, titanium, aluminum, a composite of aluminum and carbon fiber, a composite of wood and carbon fiber, other metals, wood, plastic, carbon fiber, or any other sufficiently rigid and strong material capable of supporting heavy loads. Further, the upper pivoting joint 46 and lower pivoting joint 48 can be a slip joint, a ball joint, a U-joint, or any other such joint that allows the separate sections of the frame to move independently of each other. The other components of the backpack frame 34 can be made from various materials such as fabric, plastic, metal, webbing, foam, carbon fiber, or any other such material.

Figure 11:
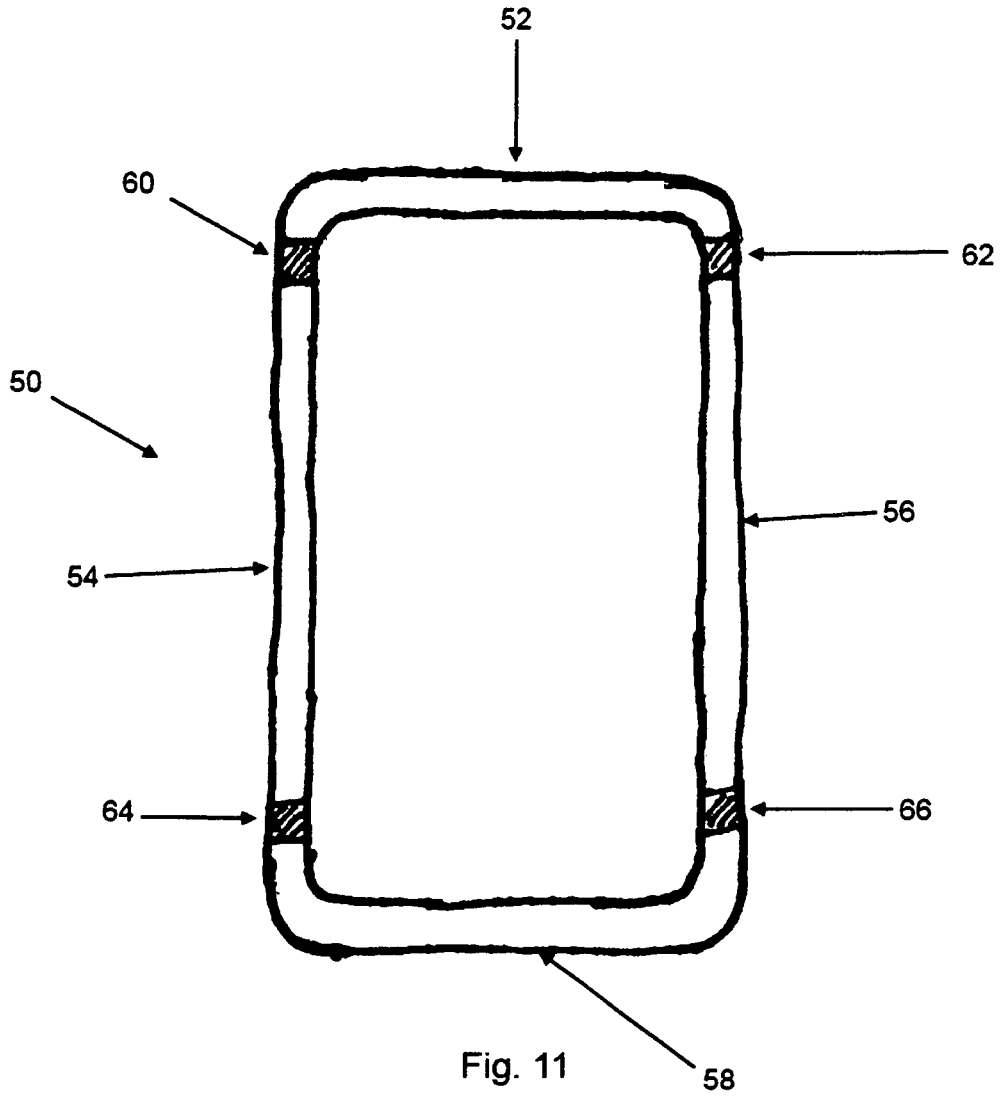
FIG. 11 is a front view of a backpack frame according to one aspect.

Referring now to FIG. 11, there is shown a backpack frame 50 being comprised of a top frame section 52, a left frame section 54, a right frame section 56, a bottom frame section 58, an upper left pivoting joint 60, an upper right pivoting joint 62, a lower left pivoting joint 64, and a lower right pivoting joint 66.

In more detail, still referring to FIG. 11, the backpack frame 50 is stiff and strong but top frame section 52, left frame section 54, right frame section 56, and bottom frame section 58 are allowed to move independently of each other due to the pivoting action provided by upper left pivoting joint 60, upper right pivoting joint 62, lower left pivoting joint 64, and lower right pivoting joint 66.

In further detail, still referring to FIG. 11, the backpack frame 50 is sufficiently wide and tall to provide comfortable carry of heavy loads, such as about 12 to 16 inches wide and about 22 to 36 inches tall. Further, upper left pivoting joint 60, upper right pivoting joint 62, lower left pivoting joint 64, and lower right pivoting joint 66 are joints that allow top frame section 52, left frame section 54, right frame section 56, and bottom frame section 58 to move independently of each other.

The construction details as shown in FIG. 11 are that the backpack frame 50 may be made of steel, titanium, aluminum, a composite of aluminum and carbon fiber, a composite of wood and carbon fiber, other metals, wood, plastic, carbon fiber, or any other sufficiently rigid and strong material capable of supporting heavy loads. Further, the upper left pivoting joint 60, upper right pivoting joint 62, lower left pivoting joint 64, and lower right pivoting joint 66 can be slip joints, ball joints, U-joints, or any other such joint that allows the separate sections of the frame to move independently of each other. The other components of the backpack frame 50 can be made from various materials such as fabric, plastic, metal, webbing, foam, carbon fiber, or any other such material.

The advantages of the present invention include, without limitation, that it is strong, stiff, and capable of stabilizing heavy backpack loads in comfort. Further, due to the articulating action of the frames it is also comfortable at light backpack loads because it matches the movements of the wearer's upper body.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A backpack comprising:

a rigid backpack frame comprising a left frame section having a distal end and a proximal end, and a right frame section having a distal end and a proximal end wherein the left frame section is substantially "L"-shaped, and wherein the right frame section is substantially "L"-shaped;

at least one pivoting joint that couples the proximal end of the left frame section to the proximal end of the right frame section such that the proximal end of the left frame section and the proximal end of the right frame section are co-axially aligned along a rotation axis, wherein the left frame section is rotatable relative to the right frame section between a first frame position in which the distal ends of the left frame section and the right frame section are coplanar and spaced from each other a first distance, and a second frame position in which the distal ends of the left frame section and the right frame section are not coplanar and are spaced from each other a second distance that is greater than the first distance, wherein no portion of the backpack frame extends substantially below the at least one pivoting joint, wherein the backpack frame is substantially "U"-shaped, wherein the backpack frame has a frame plane that is substantially parallel to the rotation axis, wherein the proximal end of the left frame section and the proximal end of the right frame section are spaced from the frame plane, wherein at least a portion of the left frame section and at least a portion of the right frame section are arcuate when viewed from a direction substantially parallel to the rotation axis, wherein, in the first frame position the distal end of the left frame section and the distal end of the right frame section are in the frame plane, and wherein in the second frame position, at least one of the distal end of the left frame section and the distal end of the right frame section is spaced from the frame plane.

2. The backpack of claim 1, wherein the left frame section is rotatable relative to the right frame section.

3. The backpack of claim 1, wherein the at least one pivoting joint comprises a plurality of pivoting joints.

4. The backpack of claim 1, wherein the at least one pivoting joint comprises a slip joint.

5. The backpack of claim 1, further comprising a bottom encasement configured to at least partially control articulation of the backpack frame.

6. The backpack of claim 5, further comprising a top encasement configured to at least partially control articulation of the backpack frame, wherein the distal end of the left frame section and the distal end of the right frame section are positioned in the top encasement.

7. The backpack of claim 6, further comprising a shoulder harness coupled to the top encasement and to the bottom encasement, wherein the shoulder harness is configured to be worn by a user.

8. The backpack of claim 6, wherein the top encasement comprises a spreader bar, and wherein the spreader bar is configured to space the distal end of the left frame section and the distal end of the right frame section a predetermined distance.

9. The backpack of claim 6, wherein the top encasement comprises a spreader bar, and wherein the spreader bar is configured to limit articulation of the distal end of the left frame section relative to the distal end of the right frame section.

10. A backpack to be worn by a user comprising:

a rigid backpack frame comprising:

a substantially "L"-shaped left frame section having a distal end and a proximal end;

a substantially "L"-shaped right frame section having a distal end and a proximal end; and at least one pivoting joint that couples the proximal end of the left frame section to the proximal end of the right frame section, wherein the proximal end of the left frame section and the proximal end of the right frame section are co-axially aligned along a rotation axis, wherein at least a portion of the left frame section and at least a portion of the right frame section are arcuate when viewed from a direction parallel to the rotation axis, and wherein the left frame section is articulable relative to the right frame section between a first frame position, in which the distal ends of the left frame section and the right frame section are coplanar and spaced from each other a first distance, and a second frame position, in which the distal end of the left frame section is spaced from the distal end of the right frame section a second distance that is greater than the first distance;

a top encasement, wherein the distal end of the left frame section and the distal end of the right frame section are coupled to the top encasement;

a bottom encasement, wherein the proximal end of the left frame section and the proximal end of the right frame section are coupled to the bottom encasement;

a shoulder harness coupled to the top encasement and to the bottom encasement, wherein the shoulder harness is configured to be worn by the user; and a hipbelt coupled to the bottom encasement, wherein the hipbelt is configured to be worn by the user, wherein when worn by the user, the at least one pivoting joint and the proximal ends of the left frame section and the right frame section form the lowest portion of the backpack frame.

11. The backpack frame of claim 1, wherein the backpack frame is configured to be stiff under heavy loads, and wherein the backpack frame is configured to articulate at light loads.

12. The backpack frame of claim 1, wherein the left frame section is articulable relative to the right frame section only about a single rotation axis.

13. The backpack frame of claim 2, wherein rotation of the left frame relative to the right frame section is only about the rotation axis.

14. A backpack frame comprising:

a rigid "L"-shaped left frame section having a distal end and a proximal end;

a rigid "L"-shaped right frame section having a distal end and a proximal end; and at least one pivoting joint that couples the proximal end of the left frame section to the proximal end of the right frame section, wherein the backpack frame is substantially "U"-shaped having a first upper end and a second lower end that is opposed to the first upper end, wherein the at least one pivoting joint is positioned on the second lower end, wherein no portion of the backpack frame extends below the second lower end, wherein the left frame section is articulable relative to the right frame section between a first frame position, in which the distal ends of the left frame section and the right frame section are coplanar and spaced from each other a first distance, and a second frame position, in which the distal end of the left frame section is spaced from the distal end of the right frame section a second distance that is greater than the first distance, wherein the proximal end of the left frame section and the proximal end of the right frame section are co-axially aligned along a rotation axis, wherein at least a portion of the left frame section and at least a portion of the right frame section are arcuate when viewed from a direction parallel to the rotation axis, wherein the backpack frame has a frame plane that is substantially parallel to the rotation axis, wherein, in the first frame position, the distal end of the left frame section and the distal end of the right frame section are in the frame plane, and wherein in the second frame position, at least one of the distal end of the left frame section and the distal end of the right frame section is spaced from the frame plane.

15. The backpack of claim 1, wherein the left frame section and the right frame section are rigid in all directions.

16. The backpack of claim 15, wherein the left frame section and the right frame section are formed from aluminum.

* * * * *